US005556034A

United States Patent [19]

Sakakida et al.

[11] Patent Number: 5,556,034

[45] Date of Patent: Sep. 17, 1996

[54] FUEL INJECTION VALVE

[75] Inventors: Akihiro Sakakida; Hideo Ohara; Hiroyuki Miyake; Kazunari Kaneshima, all of Wako, Japan

[73] Assignee: Honda Giken Kogyo Kabushiki Kaisha, Tokyo, Japan

[21] Appl. No.: 353,272

[22] Filed: Dec. 5, 1994

[30] Foreign Application Priority Data

Dec. 6, 1993 [JP] Japan ..... 5-305380

[51] Int. Cl.[6] ..... F02M 69/04

[52] U.S. Cl. ..... 239/417.3; 239/585.5

[58] Field of Search ..... 239/585.1, 585.5, 239/533.12, 432, 417.5, 407, 422, 423, 424

[56] References Cited

U.S. PATENT DOCUMENTS

| | | | |
|---|---|---|---|
| 4,657,189 | 4/1987 | Iwata | 239/585.4 |
| 4,773,374 | 9/1988 | Kiuchi et al. | 239/533.12 X |

FOREIGN PATENT DOCUMENTS

| | | | |
|---|---|---|---|
| 59-43962 | 3/1984 | Japan . | |
| 209967 | 7/1992 | Japan | 239/533.12 |
| 350361 | 12/1992 | Japan | 239/533.12 |
| 350362 | 12/1992 | Japan | 239/533.12 |
| 4-362272 | 12/1992 | Japan . | |
| 365968 | 12/1992 | Japan | 239/585.4 |
| 2225382 | 5/1990 | United Kingdom | 239/533.12 |

*Primary Examiner*—Kevin P. Weldon

*Attorney, Agent, or Firm*—Nikaido Marmelstein Murray & Oram LLP

[57] ABSTRACT

A fuel injection valve is provided which produces good atomization of fuel and increases the accuracy of the distribution rate of the fuel to a pair of diverging injection holes, even when the amount of assist air is decreased. The fuel injection valve includes a valve housing having a pair of diverging injection holes which diverge from each other in the forward direction with respect to a junction disposed in front of a fuel injection hole. The valve housing is provided with air supply passages for supplying assist air to a fuel flow injected from the fuel injection hole. A pintle inserted through the fuel injection hole has a tip end portion reduced in diameter in the forward direction and is coaxially connected to a valve member. The diameter D of the fuel injection hole, the width W of the junction in a plane intersecting axes of the diverging injection holes and the distance L from the fuel injection hole to the junction are determined to satisfy relations, $0.04<W/D<0.4$ and $0.5<L/D<10$.

8 Claims, 5 Drawing Sheets

$W / D \leq 0.04$ $0.04 < W / D < 0.4$ $0.4 \leq W / D$

FUEL INJECTION VALVE

BACKGROUND OF THE INVENTION

1. Field of the Invention

The present invention is directed to a fuel injection valve comprising a valve housing including a valve housing body which has a valve seat provided on an inner surface at a front end thereof and a fuel injection hole centrally opening into the valve seat. A valve member is contained in the housing body and is seatable onto the seat. A cap is positioned in the front end of the valve housing body and has a pair of diverging injection holes diverging from each other in a forward direction from a junction positioned in front of the fuel injection hole. The valve housing has air supply passages for supplying assist air to the fuel flow injected from the fuel injection hole.

2. Description of the Prior Art

Fuel injection valves have been conventionally known, for example, as shown in Japanese Patent Application Laid-open Nos. 43962/84 and 362272/92.

In the fuel injection valve disclosed in above Japanese Patent Application Laid-open No. 43962/84, a pintle is integrally connected to a valve member, so that the fuel is atomized by the pintle. In addition, the atomization is enhanced by an assist air from air supply passages. However, the pintle has an enlarged portion at its tip end, and hence, the fuel from the fuel injection hole collides against the enlarged portion, so that the fuel spray flow is spread. This results in a relatively large amount of fuel being deposited on an inner surface of the valve cap. For this reason, if the amount of assist air from the air supply passages is relatively small, the particle size of the fuel spray flow from the fuel injection valve is relatively large.

In the fuel injection valve disclosed in Japanese Patent Application Laid-open No. 362272/92, in addition to the atomization of the fuel by the collision of the fuel spray flow from the fuel injection hole against a junction, the atomization is promoted by the assist air from the air supply passages. Therefore, good atomization can be achieved even when the amount of assist air supplied is relatively small, but a variation in rate of distribution to the pair of diverging injection holes is liable to be produced due to the turbulence of a beam-like spray of the fuel from the fuel injection hole.

SUMMARY OF THE INVENTION

The present invention has been developed with the above problems in view, and it is an object of the present invention to provide a fuel injection valve, wherein even when the amount of assist air supplied is decreased, good atomization can be provided, and the accuracy of the distribution rate of the fuel to the pair of diverging injection holes can be increased.

To achieve the above object, according to the present invention, a fuel injection valve is provided which comprises a valve housing having a valve housing body containing a valve member capable of seating on a valve seat, and a valve cap provided on a front end of the valve housing body. The valve seat is provided on an inner surface of a front end of the valve housing body. The valve housing body also includes a fuel injection hole centrally opening into the valve seat. The cap includes a pair of diverging injection holes which diverge from each other in a forward direction from a junction positioned in front of the fuel injection hole. The valve housing includes air supply passages for supplying assist air toward the fuel flow injected from the fuel injection hole. The valve member has a pintle coaxially and continuously formed with the valve member. The pintle is inserted through the fuel injection hole and has a tip end portion tapered in a forward direction. The diameter D of the fuel injection hole, the width W of the junction in a plane intersecting the axes of both the diverging injection holes and the distance L from the fuel injection hole to the junction are determined to satisfy relations of $0.04<W/D<0.4$ and $0.5<L/D<10$.

DETAILED DESCRIPTION OF THE PREFERRED EMBODIMENT

The present invention will now be described by way of a preferred embodiment with reference to the accompanying drawings.

Figure 1:
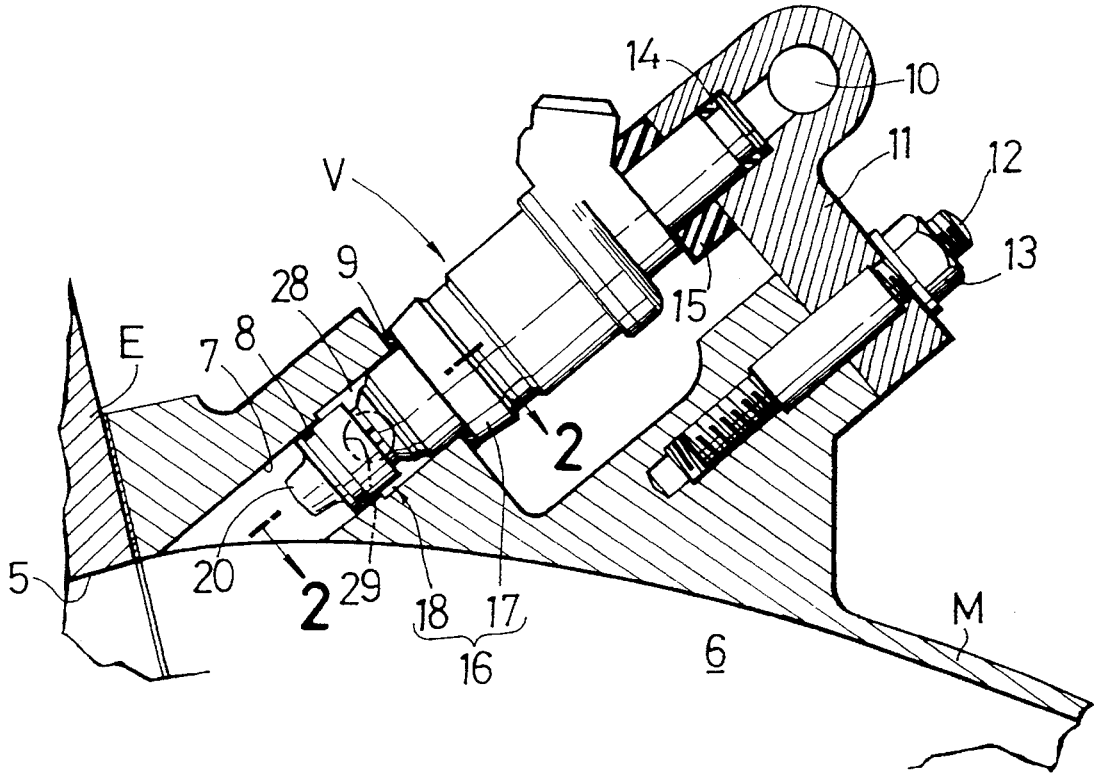
FIG. 1 is a vertical sectional side view of a fuel injection valve in a mounted state.

Referring to FIG. 1, an intake manifold M is connected to an engine body E having an intake port 5 which is common to a pair of intake valve bores (not shown) for each cylinder, and has an intake passage 6 which is in communication with the intake port 5. A mounting hole 7 is provided in the intake manifold M adjacent the engine body E in correspondence with the intake passage 6. A tip end of a fuel injection valve V is fitted into the mounting hole 7 with an annular sealing member 8 interposed therebetween. A resilient seal ring 9 is interposed between the mounting hole 7 and the fuel injection valve V. A retainer 11 having a fuel supply passage 10, is secured to the intake manifold M by a bolt 12 and nut 13. The rear end of the fuel injection valve V is fitted into the retainer 11 with an annular sealing member 14 and communicates with the fuel supply passage 10. A resilient seal ring 15 is positioned between a rear portion of the fuel injection valve V and the retainer 11.

Figure 2:
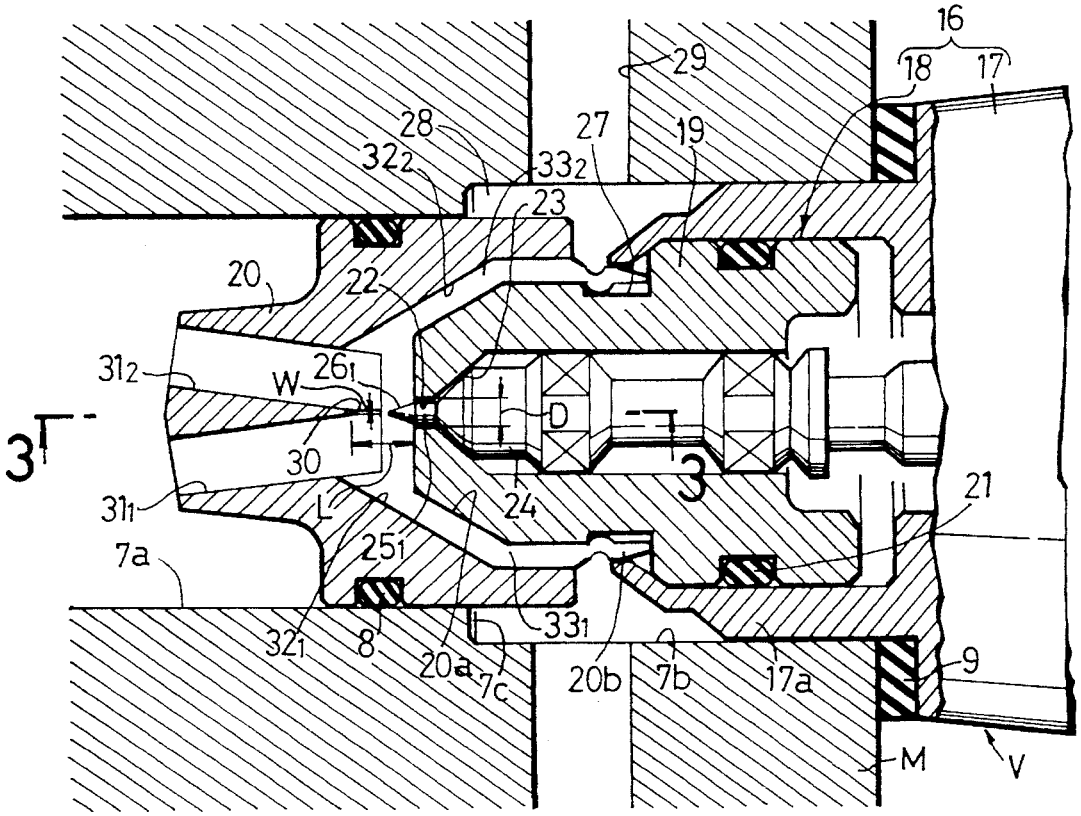
FIG. 2 is an enlarged sectional view taken along a line 2—2 in FIG. 1.
Figure 3:
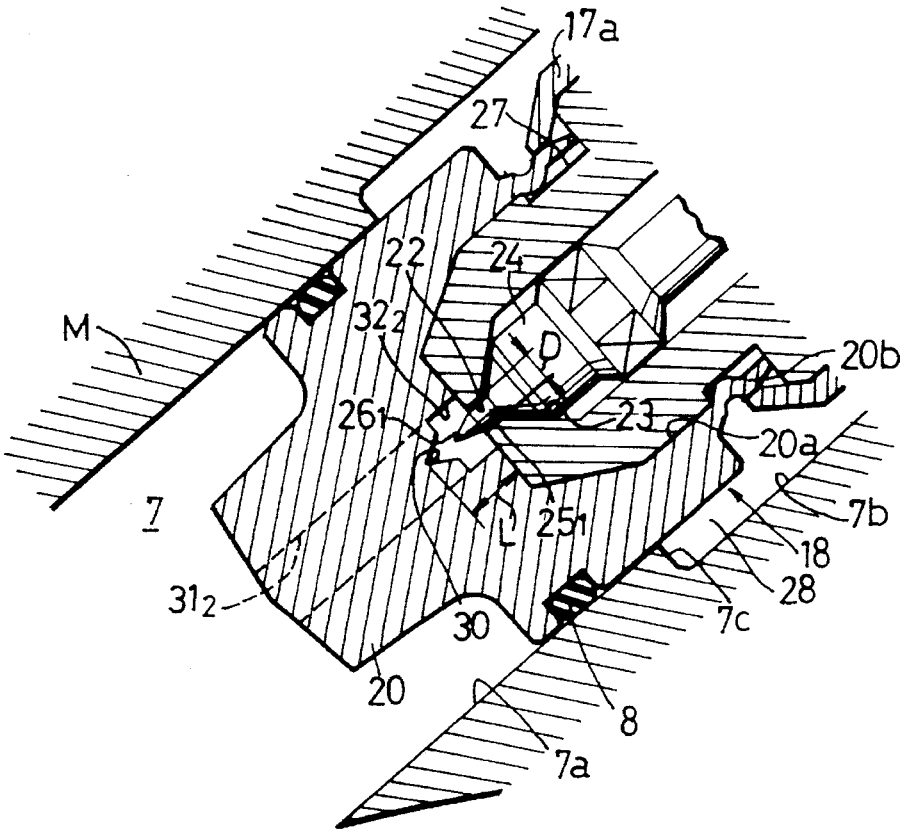
FIG. 3 is a sectional view taken along a line 3—3 in FIG. 2.

Referring to FIGS. 1–3, the fuel injection valve V has a housing 16 which is comprised of a drive portion housing 17 containing an electromagnetic drive portion (not shown) therein, and a valve housing 18. The drive portion and valve housings are coupled with each other. The valve housing 18 is coupled to a front end of the drive portion housing 17 by caulking a thin cylindrical portion 17*a* provided at the front end of the drive portion housing 17 to an outer surface of the valve housing 18.

The valve housing 18 is formed by caulking a valve housing body 19, formed into a cylindrical shape, with a valve cap 20 for covering a front end of the valve housing body 19. The thin cylindrical portion 17*a* of the drive portion housing 17 is caulked to an outer periphery of the valve housing body 19. An annular sealing member 21 is mounted on the outer periphery of the valve housing body 19 to come into contact with inner surface of the thin cylindrical portion 17*a* around its inner circumference.

A fuel injection hole 22 is provided in the center of the front end of the valve housing body 19, and a tapered valve seat 23 is provided on an inner surface of the front end of the valve housing body 19 adjacent the injection hole 22. An axially movable valve member 24 is positioned in the valve housing body 19 and seatable onto the valve seat 23. The valve member 24 is driven axially by the electromagnetic drive portion located in the drive portion housing 17, between a position in which it is seated on the valve seat 23 to close the fuel injection hole 22, and a position in which it is separated from the valve seat 23 to open the fuel injection hole 22. When the valve member 24 is separated from the valve seat 23, fuel from the fuel supply passage 10 (see FIG. 1) is injected forwardly (leftwardly as viewed in FIG. 2) from the fuel injection hole 22.

A pintle $\mathbf{25}_1$ inserted through the fuel injection hole 22, is coaxially and integrally formed on the front end of the valve member 24. The pintle $\mathbf{25}_1$ has a tapered tip end portion $\mathbf{26}_1$, so that the diameter thereof is reduced as toward its tip point.

Figure 4:
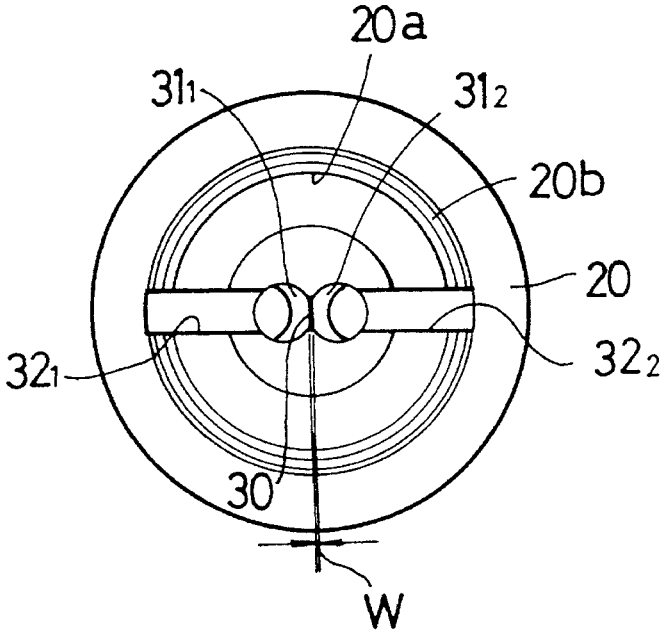
FIG. 4 is a rear view of a cap.

Referring to FIG. 4, the valve cap 20 is provided at its rear portion with a fitting recess 20*a* into which the front end of the valve housing body 19 is fitted. A rearwardly extending thin cylindrical portion 20*b* is coaxially formed on the rear portion of the cap 20. The valve housing body 19 has an annular engagement groove 27 provided in its outer periphery. The cap 20 is coupled to the valve housing body 19 by caulking the thin cylindrical portion 20*b* to engage the engagement groove 27 in the slate where the front end of the valve housing body 19 is fitted into the fitting recess 20*a*.

The tip end of the fuel injection valve V is fitted in the mounting hole 7 in the manifold M. The mounting hole 7 includes a smaller-diameter portion 7*a* which receives the cap 20 having the sealing member 8 mounted around its outer periphery, and a larger-diameter portion 7*b* which receives the thin cylindrical portion 17*a* of the drive portion housing 17. The smaller-diameter and larger-diameter portions 7*a* and 7*b* are coaxially connected to each other through a step 7*c*. An annular path 28 is defined between the outer surface of the tip end of the fuel injection valve V and the inner surface of the mounting hole 7. Axially opposite sides of the annular path 28 are bounded by the step 7*c* and the thin cylindrical portion 17*a*. The intake manifold M is provided with an air passage 29 which leads to the annular path 28. The air passage 29 is connected to an air pressure source which is not shown.

A pair of diverging injection holes $\mathbf{31}_1$ and $\mathbf{31}_2$ are provided in the cap 20 in correspondence to the pair of intake valve bores in the engine body E when the fuel injection valve V is mounted in the manifold M. The diverging injection holes $\mathbf{31}_1$ and $\mathbf{31}_2$ diverge, in an inclined manner, from a junction 30 such that the diverging injection holes $\mathbf{31}_1$ and $\mathbf{31}_2$ are separated from each other at their forward ends. The injection holes $\mathbf{31}_1$ and $\mathbf{31}_2$ open at their rear ends into a closed end of the fitting recess 20*a*. When the valve housing body 19 and the cap 20 are coupled to each other, the junction 30 is located in front of the fuel injection hole 22 in the valve housing body 19 and forms a narrow flat surface in a plane intersecting the axes of the diverging injection holes $\mathbf{31}_1$ and $\mathbf{31}_2$.

A pair of grooves $\mathbf{32}_1$ and $\mathbf{32}_2$ are provided in an inner surface of the fitting recess 20*a* in the cap 20 to extend from the closed end of the fitting recess 20*a* to the tip end of the thin cylindrical portion 20*b* along the plane passing the axes of the diverging injection holes $\mathbf{31}_1$ and $\mathbf{31}_2$. The grooves $\mathbf{32}_1$ and $\mathbf{32}_2$ are formed into slits which also open into an outer periphery at the thin cylindrical portion 20*b*. When the valve cap 20 and the valve housing body 19 are coupled to each other, the grooves $\mathbf{32}_1$ and $\mathbf{32}_2$ define air-supply passages $\mathbf{33}_1$ and $\mathbf{33}_2$ for supplying assist air to the fuel flow injected from the fuel injection hole 22 positioned between the grooves $\mathbf{32}_1$ and $\mathbf{32}_2$. The rear ends of the air-supply passages $\mathbf{33}_1$ and $\mathbf{33}_2$ are in communication with the annular path 28.

In such a fuel injection valve V, the diameter D of the fuel injection hole 22, the width W of the junction 30 in the plane passing the axes of the diverging injection holes $\mathbf{31}_1$ and $\mathbf{31}_2$, and the distance L from the fuel injection hole 22 to the junction 30 are determined so that following expressions (1) and (2) are satisfied:

$$0.04<W/D<0.4 \quad (1)$$

and $$0.5<L/D<10 \quad (2)$$

In an operation when the valve member 24 has been separated from the valve seat 23, the fuel is injected forwardly from the annular gap between the fuel injection hole 22 and the pintle $\mathbf{25}_1$ to collide against the junction 30, so that it is atomized, wherein the atomization of the fuel is enhanced by the assist air from the air supply passages $\mathbf{33}_1$ and $\mathbf{33}_2$. In this manner, the fuel is injected into hole 7 in manifold M from the diverging injection holes $\mathbf{31}_1$ and $\mathbf{31}_2$.

In this case, the fuel injected forwardly from the annular gap between the fuel injection hole 22 and the pintle $\mathbf{25}_1$ flows along the outer surface of the pintle $\mathbf{25}_1$. The fuel spray flow from the fuel injection hole 22 converges toward the junction 30, because the tip end portion $\mathbf{26}_1$ of the pintle $\mathbf{25}_1$ is tapered with diameter reduced toward the tip point. However, if the distance L between the fuel injection hole 22 and the junction 30 is too small relative to the diameter D of the fuel injection hole 22, the fuel spray flow which reaches the junction 30 is not sufficiently converged, so that it does not sufficiently collide against the junction 30. On the other hand, if the distance L is too large relative to the diameter D, a variation in rate of distribution of the fuel to the diverging injection holes $\mathbf{31}_1$ and $\mathbf{31}_2$ is produced, and turbulence is produced in the fuel spray flow. Therefore, the present inventors conducted experiments for studying the collision of the fuel spray flow against the junction 30 with varied ratios L/D. The results showed that if $L/D \leqq 0.5$, the fuel spray flow reached the junction 30 while not being sufficiently converged and hence, a sufficient atomization of the fuel was not provided due to an unreliable collision of the fuel spray flow against the junction 30. If $10 \leqq L/D$, a variation in rate of distribution of the fuel to the diverging injection holes $\mathbf{31}_1$ and $\mathbf{31}_2$ was produced. Thus, by determining the distance L and the diameter D in a range of $0.5<L/D<10$ according to the present invention, the fuel spray flowing from the fuel injection hole 22 is allowed to reliably collide against the junction 30 while being converged at the tip end portion $\mathbf{26}_1$ of the pintle $\mathbf{25}_1$ to thereby provide a sufficient atomization of the fuel and an increased accuracy of the distribution rate of the fuel to the diverging injection holes $\mathbf{31}_1$ and $\mathbf{31}_2$.

Even if the equal divergence of the fuel to the diverging injection holes $\mathbf{31}_1$ and $\mathbf{31}_2$ has been achieved, if the width W of the junction 30 is too small relative to the diameter D of the fuel injection hole 22, a sufficient release of the fuel flow from the junction 30 cannot occur upon collision of the fuel spray flow against the junction 30, resulting in a fuel spray flow offset toward the inner surfaces of the diverging injection holes $\mathbf{31}_1$ and $\mathbf{31}_2$. On the other hand, if the width W of the junction 30 is too large relative to the diameter D, the spreading of the fuel spray flow provided upon the collision against the junction 30 is increased, resulting in a fuel spray flow offset toward the outer surfaces of the diverging injection holes $\mathbf{31}_1$ and $\mathbf{31}_2$. Therefore, the atomization of the fuel jet from the fuel injection valve V is obstructed due to the mutual deposition of fuel particles atomized by the collision against the junction 30 and by the assist air.

Figure 5A:
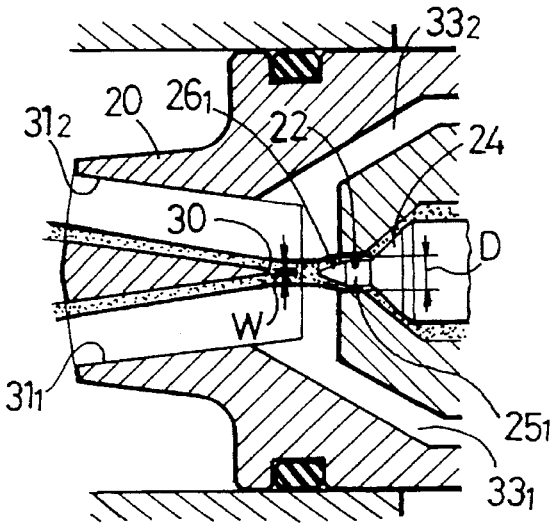
FIGS. 5A, 5B and 5C are views illustrating the flow of a fuel according to the ratio W/D.
Figure 5B:
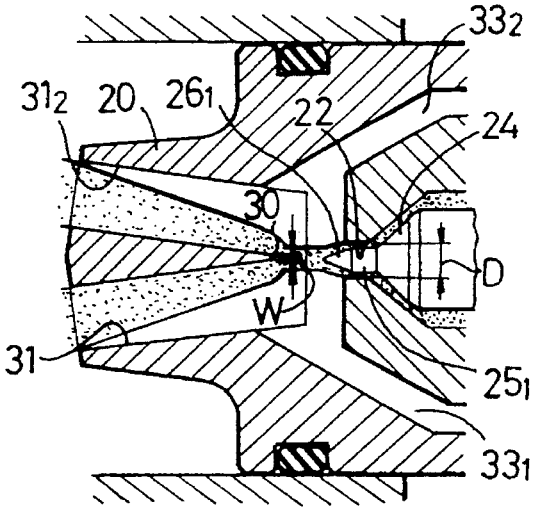
Figure 5C:
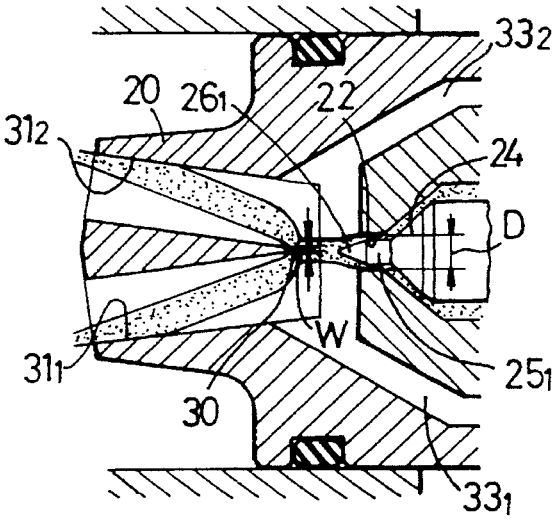

Therefore, the present inventors observed the state of the fuel spray flow in the diverging injection holes $\mathbf{31}_1$ and $\mathbf{31}_2$ with varied ratios W/D. The result showed that if $W/D \leqq 0.04$, the fuel flow was not released sufficiently from the junction 30, resulting in a fuel spray flow offset toward the inner surfaces of the diverging injection holes $\mathbf{31}_1$ and $\mathbf{31}_2$, as shown in FIG. 5A. On the other hand, if $0.4 \leqq W/D$, the spreading of the fuel spray flow from the junction 30 was increased, resulting in a fuel spray flow offset toward the outer surfaces of the diverging injection hole $\mathbf{31}_1$ and $\mathbf{31}_2$, as shown in FIG. 5C. Thus, by determining the ratio W/D in a range of $0.04<W/D<0.4$ according to the present invention, the fuel spray flow after collision against junction 30 flows equally in the diverging injection holes $\mathbf{31}_1$ and $\mathbf{31}_2$ without offset, and is injected from the diverging injection holes $\mathbf{31}_1$ and $\mathbf{31}_2$ while being maintained in its atomized form, as shown in FIG. 5B.

Figure 6:
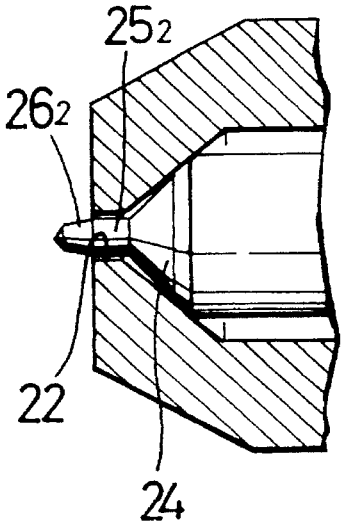
FIG. 6 is a sectional view illustrating a first modification to a pintle in the present invention.

FIG. 6 illustrates a first modification to the pintle. A pintle $\mathbf{25}_2$, coaxially and integrally connected to the valve member 24, has a tip end portion $\mathbf{26}_2$ which is formed into a two-stepped tapered shape with its diameter reduced in a forward direction. In a fuel injection valve having such pintle $\mathbf{25}_2$, an effect similar to that in the above-described embodiment can be provided.

Figure 7:
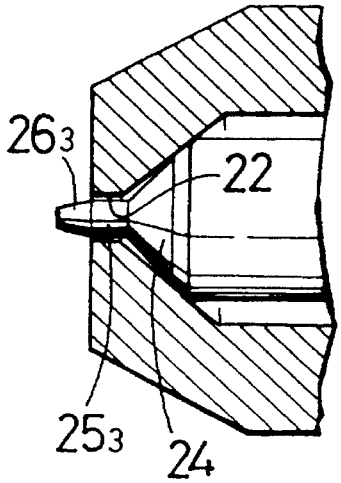
FIG. 7 is a sectional view illustrating a second modification to the pintle.
Figure 8:
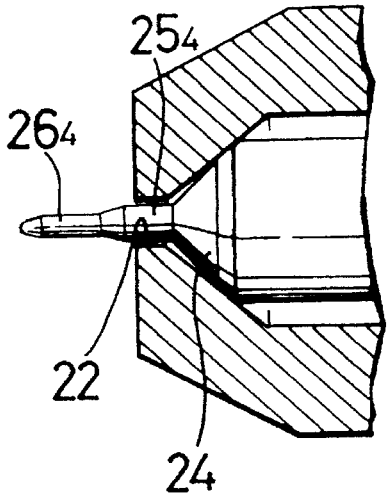
FIG. 8 is a sectional view illustrating a third modification to the pintle.

In a second modification shown in FIG. 7, a pintle $\mathbf{25}_3$ has a tip end $\mathbf{26}_3$ of a tapered shape with its diameter reduced in a forward direction. The tip end $\mathbf{26}_3$ has a flat tip face, which may be coaxially and integrally connected to the valve member 24. Further, in a third modification shown in FIG. 8, a pintle $\mathbf{25}_4$ has a tip end portion $\mathbf{26}_4$ which is stepwise reduced in diameter in a forward direction and may be coaxially and integrally connected to the valve member 24.

As discussed above, according to the present invention, since the pintle is inserted through the fuel injection hole, has the tip end portion reduced in diameter in the forward direction and is coaxially connected to the valve member, it is possible to reliably introduce the fuel injection flow from the fuel injection hole to the junction while converging it. By determining the ratio W/D in the range of $0.04<W/D<0.4$, it is possible to allow the fuel injection flow from the fuel injection hole to reliably collide against the junction, thereby providing sufficient atomization of the fuel and increased accuracy of the distribution rate to the diverging injection holes. Further, by determining the ratio L/D in the range of $0.5<L/D<10$, it is possible to prevent the offsetting of the fuel spray flow within the diverging injection holes and thus, to constantly provide good atomization irrespective of an increase or decrease in amount of assist air supplied, and to provide increased accuracy of the distribution rate to the diverging injection holes, thereby realizing equal fuel spray flows within the diverging injection holes.

Although the preferred embodiment of the present invention has been described in detail, it will be understood that the present invention is not limited to the above-described embodiment, and various modifications in design may be made without departing from the spirit and scope of the invention defined in the claims.

What is claimed:

1. A fuel injection valve comprising:

(a) a valve housing having a valve body, a valve seat on an inner surface of said valve body, a fuel injection hole positioned in a center of said valve seat, and air supply passages for supplying assist air to fuel injected from said fuel injection hole;

(b) a valve member coaxially aligned with said valve seat, said valve member having a pintle formed on a front end thereof, said pintle being coaxially aligned with said fuel injection hole and positioned therein; and (c) a valve cap positioned in a front portion of said valve body, in front of said fuel injection hole, said valve cap having a pair of diverging injection holes, said diverging injection holes diverging from each other in a forward direction, and junction means positioned to a rear of said diverging injection holes and in front of said fuel injection hole; wherein (d) said air supply passage being defined between said valve body and said valve cap, and wherein (e) a diameter of the fuel injection hole (D), a width of the junction means (W) in a plane intersecting axes of said diverging injection holes, and a distance (L) from the fuel injection hole to the junction means satisfy the relationships $$0.04<W/D<0.4 \quad \text{(i)}$$

$$0.5<L/D<10 \quad \text{(ii)}.$$

2. A fuel injection valve as set forth in claim 1, wherein said pintle includes a tapered portion.

3. A fuel injection valve as set forth in claim 2, wherein said pintle includes two tapered portions, the more forward portion being more tapered than the rearward portion.

4. A fuel injection valve as set forth in claim 2, wherein a portion of said pintle in front of said tapered portion, is flat in a plane perpendicular to the axis of said pintle.

5. A fuel injection valve as set forth in claim 2, wherein said pintle includes two cylindrical portions, said tapered portion being integrally formed between said two cylindrical portions.

6. A fuel injection valve comprising:

(a) a valve housing having a valve body, a valve seat on an inner surface of said valve body, a fuel injection hole positioned in a center of said valve seat, and air supply passages for supplying assist air to fuel injected from said fuel injection hole;

(b) a valve member coaxially aligned with said valve seat, said valve member having a pintle formed on a front end thereof, said pintle being coaxially aligned with said fuel injection hole and positioned therein; and (c) a valve cap positioned in a front portion of said valve body, in front of said fuel injection hole, said valve cap having a pair of diverging injection holes, said diverging injection holes diverging from each other in a forward direction, and junction means positioned to a rear of said diverging injection holes and in front of said fuel injection hole, said junction means having a narrow flat surface opposed to said fuel injection hole; wherein (d) a diameter of the fuel injection hole (D), a width of said narrow flat surface of the junction means (W), and a distance (L) from the fuel injection hole to the narrow flat surface of the junction means satisfy the following relationships:

$$0.04<W/D<0.4 \quad \text{(i)}$$

$$0.5<L/D<10 \quad \text{(ii)}.$$

7. A fuel injection valve as set forth in claim 6, wherein said air supply passages are defined between said valve body and said valve cap.

8. A fuel injection valve as set forth in claim 1, wherein rear ends of said air supply passages are in communication with an air passage of a manifold.

* * * * *